US008243553B2

(12) United States Patent
Veuthey et al.

(10) Patent No.: US 8,243,553 B2
(45) Date of Patent: Aug. 14, 2012

(54) PORTABLE ELECTRONIC DEVICE HAVING A HISTORY FUNCTION AND INTENDED TO DISPLAY THE VALUE OF VARIABLES ON THE BASIS OF MEASUREMENTS MADE BY A SENSOR

(75) Inventors: Jean-Bernard Veuthey, Marin (CH); Fabien Balli, Meinier (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 808 days.

(21) Appl. No.: 12/345,496

(22) Filed: Dec. 29, 2008

(65) Prior Publication Data

US 2009/0185452 A1 Jul. 23, 2009

(30) Foreign Application Priority Data

Dec. 27, 2007 (EP) ..... 07150448

(51) Int. Cl.
*G04B 47/06* (2006.01)

(52) U.S. Cl. ..... 368/11; 368/80

(58) Field of Classification Search ..... 368/11, 368/80

See application file for complete search history.

(56) References Cited

U.S. PATENT DOCUMENTS

| | | | | |
|---|---|---|---|---|
| 5,156,055 | A | 10/1992 | Hollis et al. | |
| 7,215,601 | B2 * | 5/2007 | Plancon et al. | 368/10 |
| 7,269,100 | B2 * | 9/2007 | Gilomen | 368/11 |
| 7,345,956 | B2 | 3/2008 | Matthey | |
| 7,869,308 | B2 * | 1/2011 | Rochat | 368/11 |
| 2004/0047242 | A1 * | 3/2004 | Germiquet et al. | 368/11 |
| 2007/0183264 | A1 | 8/2007 | Raeber et al. | |

FOREIGN PATENT DOCUMENTS

| | | | |
|---|---|---|---|
| EP | 1571506 | A1 | 9/2005 |
| EP | 1571507 | A1 | 9/2005 |
| WO | 2005096105 | A1 | 10/2005 |
| WO | 2005096106 | A1 | 10/2005 |

OTHER PUBLICATIONS

European Search Report issued in corresponding application No. EP07150448, completed May 27, 2008.

* cited by examiner

*Primary Examiner* — Sean Kayes
(74) *Attorney, Agent, or Firm* — Griffin & Szipl, P.C.

(57) ABSTRACT

The present invention relates to a portable electronic device (1) comprising at least two analog display elements (16, 17) to display the current time in a first operating mode, the time mode, the electronic device (1) additionally comprising a sensor (23) for a physical magnitude to measure the value of this physical magnitude as a function of time in a second operating mode and memory elements (25, 26) intended to store at least a portion of the measured values with a given period. The display elements can be controlled in the second operating mode to respectively display a value representative of the measured physical magnitude and a calculated value representative of the variation in time of the physical magnitude. The electronic device (1) has a third operating mode, the history mode, in which the analog display elements (17, 16) are actuated to respectively display, chronologically and with a time interval of predefined duration, values representative of the physical magnitude on the basis of the stored values and values representative of the variation in time of the physical magnitude calculated on the basis of the stored values. The invention also relates to a method of displaying a history.

8 Claims, 3 Drawing Sheets

PORTABLE ELECTRONIC DEVICE HAVING A HISTORY FUNCTION AND INTENDED TO DISPLAY THE VALUE OF VARIABLES ON THE BASIS OF MEASUREMENTS MADE BY A SENSOR

This application claims priority from European Patent Application No. 07150448.4 filed Dec. 27, 2007, the entire disclosure of which is incorporated herein by reference.

FIELD OF THE INVENTION

The present invention relates to a portable electronic device comprising a case containing a clock movement with a display mounted thereon, said clock movement comprising electronic circuits capable of producing time signals to be sent to control means of said display, wherein said electronic circuits can be selectively placed in one or the other of a plurality of operating modes, said plurality of operating modes comprising a first mode, the time mode, in which said display is provided to indicate the time.

The electronic device according to the invention additionally comprises a sensor provided to perform a measurement of a physical magnitude and to repeat this measurement with a given frequency. In a second mode of operation, the acquisition mode, the display is provided to supply a first indication representing the current value of said measurement and a second indication representing a variation in the time of said measurement. The electronic device further comprises memory means provided to record, in said acquisition mode, a succession of values, each corresponding to an instantaneous value of said current value, according to a given periodicity.

PRIOR ART

The patent application published under the number WO 2005/096106 A1 in the name of the applicant describes an electronic device, in which analog display members are actuated to display the current time in a first operating mode and to each display the value of a variable based on the measurement of a physical magnitude performed by a sensor of the device in a second operating mode.

The patent application published under the number WO 2005/096105 A1, also in the name of the applicant, describes an electronic device, in which two analog display members are actuated to display the current time in a first operating mode, and to respectively display the measurement of a time interval and the instantaneous depth calculated on the basis of pressure measurements performed by a sensor of the device in a second operating mode. This document provides that the electronic device comprises memory means intended to store values of the measured pressure. In a third operating mode referred to as the history mode, the stored values are used to allow the display members to reproduce the behaviour they presented during the measurements.

The storage of a series of values in order to allow the implementation of a history mode raises problems of memory management in the case of a portable device. These problems become critical when several series of values associated with one or more measured variables are to be stored, in particular with respect to space requirements of the memory and its power consumption.

A known solution to this problem is to increase the interval between successive recordings or, in other words, to increase the value of the storage period, for example as a function of the total duration of the measurements. However, such a solution shows its limitations when the duration of the measurements becomes long because the stored values become less and less representative of the measured values as a result.

SUMMARY OF THE INVENTION

A first aim of the present invention is to remedy the above-mentioned disadvantages of the prior art by providing a portable electronic device that allows visualisation of the values of two variables as a function of time, these values being based on the results of measurements previously performed by means of a sensor, while optimising the size of the memory provided in the device.

Accordingly, the invention provides a portable electronic device of the aforementioned type characterised in that, in a third mode, a history mode, said electronic circuits are provided to display, on the basis of said succession of recorded values, two chronological value sequences in parallel within a predetermined time interval, wherein a first of said sequences is directly representative of the values taken by said measurement in said acquisition mode and the other of said sequences is calculated on the basis of said succession of recorded values and is representative of the variation in time of said measurement.

The present invention also relates to a method for displaying a historical record on a device of this type.

Because of these features, a single series of values can be stored, the second series of values, corresponding to the values representing the variation in time of the measurement (or of the measured physical magnitude) is calculated each time it must be displayed. Thus, this series of values is calculated, on the one hand, during execution of the second operating mode when the measurements of the physical magnitude are acquired by the sensor and, on the other hand, during the display of the history when the measured values that have been stored are read.

According to a variant, the electronic circuits also store the time-interval during which the acquisition mode has remained active, or alternatively the value of the period defining the periodicity, according to which the memory means record the current value of the measurement. This variant represents a preferred embodiment in particular if the period does not have a single value defined by the manufacturer, but on the contrary depends on the conditions of use of the electronic device.

Advantageously, it is provided that the display of the historical record can be interrupted and then possibly resumed as a result of predefined actions of a user. Moreover, it is preferably provided that the electronic circuits of the device are also configured to implement a jump in the execution of said historical mode in response to an action of a user to actuate the analog display members, so that these shift from the display of a first value associated with a first stored value Pi to the display of a second value associated with a second stored value Pj located chronologically before or after said first stored value Pi and spaced in time from the latter by at least once the value of said given periodicity.

In this latter case, it is advantageously provided that the value representing the variation in time of said physical magnitude associated with the value Pj is calculated at least on the basis of the stored values Pj and Pj−1.

In a preferred, non-restrictive manner, the sensor used is a pressure sensor that enables altitude or depth to be measured, but it is understood that the invention can be used with other types of sensor, such as a temperature sensor or a magnetic field sensor, for example, Moreover, a certain number of variants can be provided such as a specific display of the measured values during acquisition, adaptation of the display scales in the history mode as a function of the maximum and minimum measured values, automatic or manual activation of the acquisition mode, a plurality of memory zones, each of which dedicated to a particular series of measurements, or even the provision of at least one liquid crystal screen on the dial to complement the analog display.

In addition, the electronic device according to the present invention could display other indications. In particular, the display could also provide a third indication representing a variation in the time of said second indication (i.e. an indication of acceleration of the variation in time of the measurement).

BRIEF DESCRIPTION OF THE DRAWINGS

Other features and advantages of the present invention shall become clearer on reading the following detailed description made with reference to the attached drawings and given by way of non-restrictive example, wherein.

DETAILED DESCRIPTION

Figure 1:
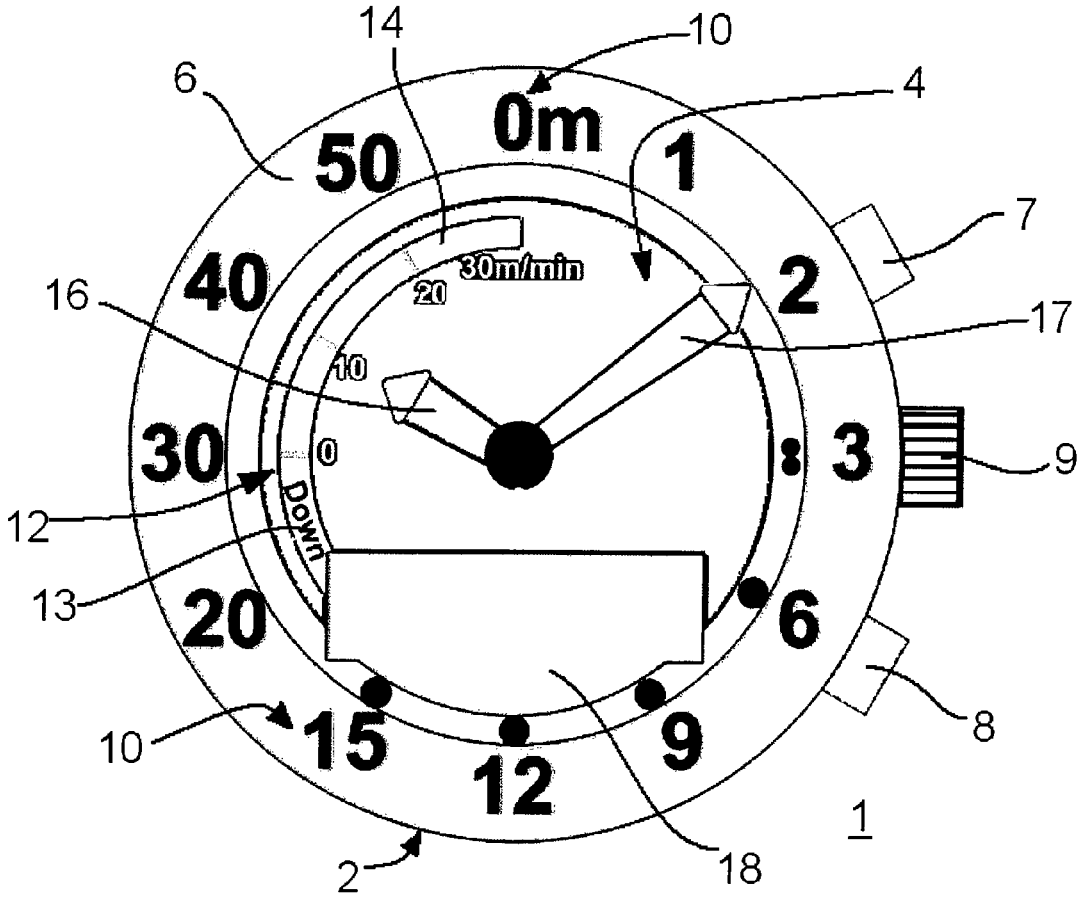
FIG. 1 is a front view of a portable electronic device according to a first embodiment of the present invention, configured in the form of a dive watch having elements for displaying a depth and the value of the vertical speed component.

FIG. 1 shows a preferred embodiment of the portable electronic device according to the invention in the form of a dive watch that is very simple both in terms of its structure and in terms of its operation. The watch 1 has the appearance of an ordinary watch. Indeed, this watch comprises a case 2, which can be made of metal with a screwed base having lugs (not shown) provided for the attachment of a wristband (not shown). The case contains a clock movement (not shown), a dial 4, and is closed at its upper face by a crystal surrounded by a fixed bezel 6. The watch 1 additionally has three traditional type control elements, i.e. two pushbuttons 7 and 8 and a winding-button 9.

It is noted that the dive watch 1 is preferably provided with a touch-sensitive crystal, i.e. that is covered with capacitive electrodes as an alternative or in addition to the pushbuttons 7 and 8 without departing from the framework of the invention.

The bezel 6 bears the first depth graduations 10 on a variable scale extending from a first indication of 0 metres located at twelve o'clock to a last indication of 50 metres arranged at eleven o'clock.

The dial 4 bears second circular graduations 12, the unit of which is metres/minute, subdivided into two zones. In clockwise direction, the first zone 13 extends from the position corresponding to the graduation of 20 metres at eight o'clock to the position corresponding to the graduation of 30 metres at nine o'clock. In clockwise direction, the second zone extends from the end of the first zone 13 to the position corresponding to the graduation 0 metres. The graduations of the second zone 14 correspond to a scale of the speed of ascent and extend between 0 m/min and 30 m/min, while the first zone corresponds to negative speeds of ascent and does not have a scale.

The watch 1 also has two hands for indicating the hours 16 and the minutes 17 respectively.

The dial 4 additionally has a window, across which a liquid crystal (LCD) screen 18 is made visible.

The watch 1 has special technical elements that will be described quickly below with respect to FIG. 2, which allow it to provide specific indications relating to the practice of diving. These technical elements comprise in particular a pressure sensor provided to perform a measurement of the ambient pressure and to repeat this measurement at close intervals, and electronic circuits enabling the values acquired by this depth measurement to be converted into depths with respect to diving. These techniques have been described in numerous documents of the prior art and will not be outlined in more detail below.

Thus, by appropriate programming of the electronic circuit of the watch according to the present invention, a first operating mode, or time mode, is provided, in which the classic functions are assured by the hour and minute hands. In addition, the winding-button 9 has two stable positions, a first stable position being the rest position in which the winding-button does not perform any function. In a conventional manner, the second stable position is a pulled-out position in relation to the rest position, in which the winding-button allows the indication of the time provided by the hands 16, 17 to be adjusted by rotation.

Conventional means are advantageously provided to perform an automatic change in operating mode, in particular to shift from time mode to a second operating mode, referred to as dive mode, when a dive commences. Conversely, these means automatically allow a return to the time mode from the dive mode when the diver, the wearer of the watch, returns to the surface. Such means are described, for example, in the patent application WO 2005/096105 A1 already mentioned.

Once the dive mode is activated, the functions respectively associated with the minute 17 and hour 16 hands are the display of the instantaneous depth and display of the speed of ascent.

It is naturally possible to provide manual means for activating the dive mode in addition or as an alternative to the automatic activation.

Since these means form part of the prior art, they will not be outlined further in the present invention on the basis that they do not represent the core of the present invention and that a person skilled in the art will not have much difficulty in implementing them.

In accordance with the present invention, the dive watch 1 comprises a third operating mode, referred to as history mode, preferably activated by an action of the user such as by applying pressure to the winding-button 9, for example, followed by a selection made by contact on the touch-sensitive crystal.

To implement the history mode, means are provided to control the hour 16 and minute 17 hands so that they exhibit a behaviour representing the execution of the dive, for which associated data have been stored.

Several variants can be provided for implementing the history mode. Since a dive can last several tens of minutes, it is preferable to control the hands 16 and 17 so that they essentially reproduce their respective past actions with accelerated speed in relation to the speed of acquisition of the measurements. A skilled person could define the parameters of acceleration that suit his own needs and program the electronic circuit of the watch appropriately without departing from the framework of the present invention. For example, a division by 60 of the total duration of the dive to be displayed can be provided, such that ten minutes of the dive are reproduced in ten seconds in the history mode.

A possible variant for implementing the history from the point of view of reproduction speed is to reproduce any dive performed, whatever its duration, in a time window predefined by the manufacturer of the watch. The time window can be defined with a fixed length or with a variable length contained between two extreme values. As an example, it can be provided that the duration of the history is fixed at 30 seconds, the movement of the hands 16 and 17 thus being adjusted to bring the actual duration of the dive to 30 seconds. Alternatively, it can also be provided that the duration of the history is contained between 15 and 30 seconds in particular as a function of the actual duration of the dive to be reproduced.

Other variants and details of implementing the history mode are presented in a non-restrictive manner in the patent application WO 2005/096105 A1.

Figure 2:
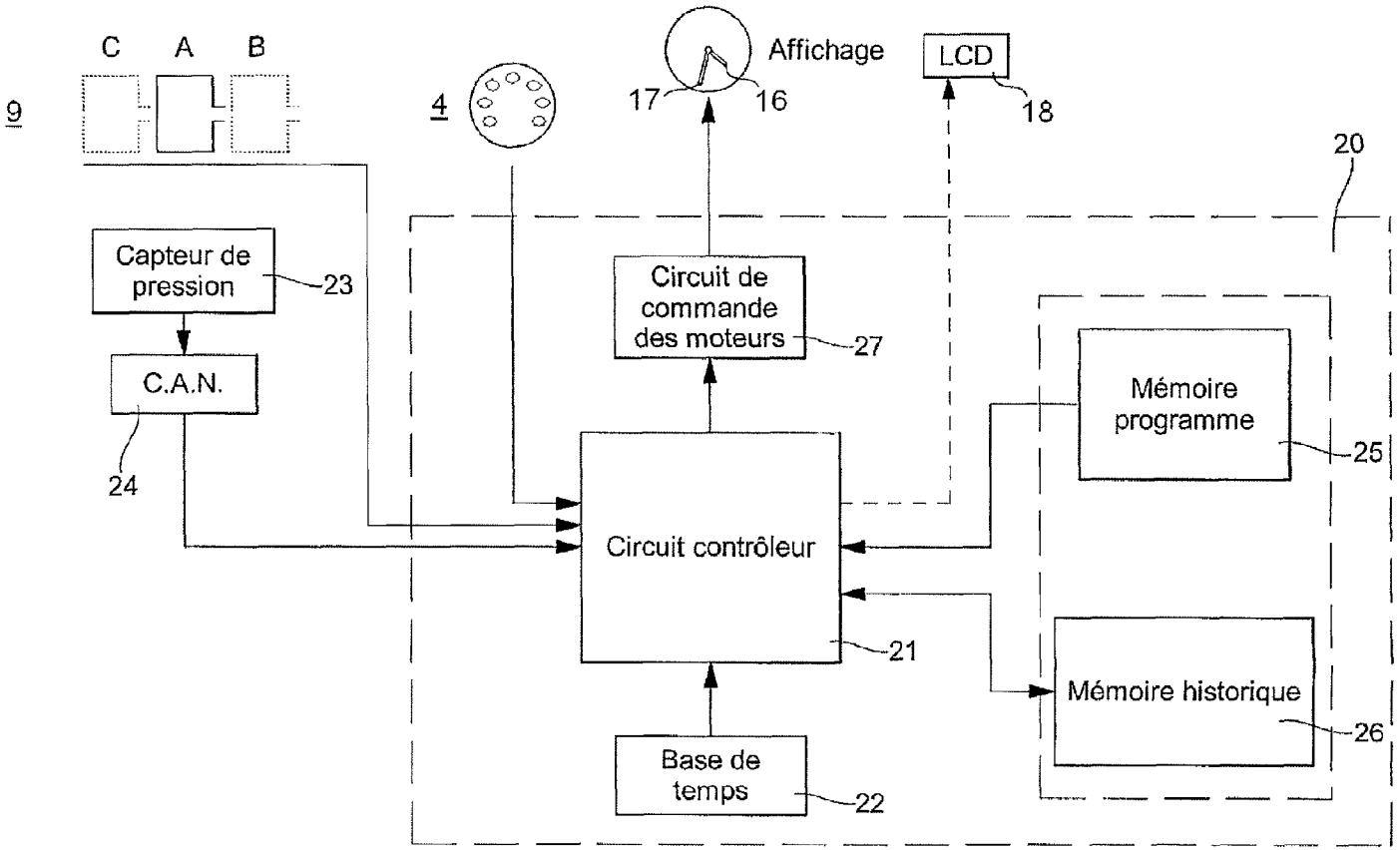
FIG. 2 shows a schematic general electronic circuit diagram of the indicator device shown in FIG. 1.

FIG. 2 is a schematic diagram of the general structure of the electronic circuit of the dive watch according to the present invention.

In general, the electronic circuit of the watch comprises in particular an integrated circuit 20 having a controller circuit 21 capable of controlling the conventional time functions of the watch 1 and comprising, for this purpose, a time division circuit connected in particular to a resonator 22 supplying a time base. From this time base, time data are produced by the controller circuit 21, in particular to assure the function of the time mode and the functionalities relating to the dive mode.

Moreover, the controller circuit 21 receives as input signals generated by a pressure sensor 23 generating analog electrical signals representing the ambient pressure. These signals pass through an analog-to-digital converter 24 before being input by the controller circuit 21 in the form of a digital signal.

The pressure sensor 23 is of conventional type and a person skilled in the art will not encounter any particular difficulty in choosing one suitable for implementing the present invention.

The integrated circuit 20 also has memory zones, in particular a first, preferably non-volatile, memory zone 25 containing a program that allows the controller circuit 21 to perform calculations relating to the dive mode such as the conversion of pressure measurements into depth values, for example, in association with a volatile memory zone (not shown). The choice of a non-volatile re-programmable memory (flash or EPROM, for example) will ultimately allow the calculation program to be updated, if necessary. The integrated circuit 20 preferably has at least a second memory zone 26, also non-volatile, in which the measurements as well as the results of the calculations performed by the controller circuit 21 are stored periodically. This second memory zone 26 is provided in particular to store depth measurements. Thus, these data are consulted by the controller circuit 21 in particular when the watch is in history mode.

From these respective input signals, the controller circuit 21 determines the situation of the diver at each instant of the dive. The controller circuit 21 then sends adjusted signals to a control circuit 27 for bi-directional motor means, e.g. two bi-directional motors, so that the hour hand 16 displays the depth variation rate facing the second graduations 12 of the dial. Moreover, the controller circuit 21 produces adjusted signals for the control circuit 27 of the motor means so that the minute hand 17 displays the instantaneous depth at each instant of the dive when facing the graduations 10 carried on the ring 6 of the watch.

In addition, the electronic circuit of the watch has conventional means (not shown) to detect pressure exerted by the user on the winding-button 9. The latter is located in the rest position A and has two end positions B and C. The unstable position B obtained by pressure from the user activates the controller circuit 21 to modify the mode of operation of the watch such as described above. It is preferred that when the winding-button 9 is pushed into position B from the time mode, the controller circuit 21 generates signals for activation of the touch-sensitive crystal 4. For a specific predefined period the user can then select a particular function by placing a finger on a zone of the touch-sensitive crystal that he/she wishes to select.

The activation of the history mode can also be associated with a predefined zone of the touch-sensitive crystal.

For technical details relating to the operation of the touch-sensitive crystal, the reader might refer to the patent document EP 0 838 737 A1 published in the name of Auslab S. A.

The skilled person is naturally able to program the integrated circuit 20 of the watch according to the present invention as he wishes to provide respective responses adapted to the different actions possible via the winding-button 9 and/or via the touch-sensitive crystal 4.

Moreover, conventional means well known to the skilled person are implemented to allow a correction of the current time indicated by hands 16 and 17, in time mode, when the winding-button 9 is pulled into the stable position C.

In addition, the integrated circuit 20 controls the display of the liquid crystal screen 18 that allows the indications of the hour and minute hands to be supplemented by the simultaneous display of additional data. According to a preferred variant, the LCD display 18 is provided to indicate the actual duration of the dive, either in real time during its execution (acquisition mode), or in the history mode. For example, it could also be provided that the maximum depth reached during the course of the dive is displayed.

Additional functionalities can also be provided on the dive watch 1. Their nature and the manner of accessing them set aside for the history mode will not be outlined in detail since they do not take any direct part in the implementation of the present invention. Examples could be found in the international applications cited above for the purposes of non-restrictive illustration.

From the point of view of operation when the diver enters the water, the watch activates the dive mode. The two hands 17 and 16 are initially positioned to face the indication corresponding to 0 metres carried by the ring 6 and at nine o'clock, in other words facing the indication 0 m/min carried by the dial 4 respectively. When the diver descends, the minute hand 17 starts to rotate clockwise to indicate the value of the instantaneous depth facing the graduations 10. At the same time, the hour hand 16 shifts to face the second graduations 12 to indicate the depth variation value.

It is noted that in the shown embodiment the first zone 13 of the seconds graduations 12 does not bear a scale. Therefore, the descent speeds are not displayed precisely, but only roughly. Such an embodiment is naturally for illustration and the person skilled in the art could use a different display adapted to his own needs without departing from the framework of the present invention.

Advantageously, it can also be provided that the depth variation rate can be calculated on the basis of a mean value formed on the basis of several successive depth values. For the purposes of non-restrictive illustration, the variation rate displayed during the dive mode by the hour hand 16 can be a sliding average of the last three instantaneous rates, these being directly calculated on the basis of measurements conducted by the pressure sensor. It is understood that in the history mode, this method of calculation cannot be applied at the very first instant of the dive. In this case, the rate initially displayed can be artificially constant to avoid the display of unrealistic values because of the calculation algorithm retained as a function of the behaviour of the user. It is possible to provide, for example, that the initial rate displayed is in the order of 10 m/min during the first seconds of the dive.

The pressure sensor can be supplied with power to perform a measurement by the second. It can preferably be provided to store each measurement in a specific memory zone at least during the first three minutes. If the dive is a free dive with a duration of less than three minutes, a sufficient number of measurements are thus stored to allow a reliable reproduction of the history of the dive.

When the dive lasts more than three minutes, it is advantageously provided that measurements are stored at a lesser frequency that the frequency of measurement of the pressure sensor. Such an arrangement allows the size of the memory zone necessary when the duration of the dive becomes more significant to be limited without appreciably impairing the quality of reproduction of the history. It is preferably provided that a pressure or depth value is recorded with a period in the order of some tens of seconds of a scuba dive, for example, every 30 seconds. Moreover, it is provided that when the duration of the dive taking place reaches 3 minutes, according to the embodiment provided above, a large portion of the stored measurements are erased in order to free the memory space required for subsequent measurements. In fact, it is thus sufficient to only keep measurements previously conducted at time intervals of a duration that corresponds to the period provided for recording the measurements of scuba dives, i.e. 30 seconds according to the embodiment mentioned above.

If one considers the preceding digital example given for the purpose of non-restrictive illustration, the storage of the first three minutes of a dive requires 180 storage locations and this number is then reduced to 6 when the duration of the dive goes beyond 3 minutes. On the other hand, as the dive extends, because of the lesser frequency of storage actions, it becomes possible to store the profile of the dive for a maximum duration of one and a half hours with such a number of storage locations, and this is sufficient to meet the needs of a large majority of divers.

The patent application WO 2005/096105 A1 discloses an alternative embodiment defining a more progressive variation in the frequency of storing measurement results. A skilled person could refer to this disclosure or to any other known adapted method to optimise management of the memory of the watch according to the invention.

To limit the memory space necessary to store pressure measurements, the present invention proposes to limit the quantity of data to be stored. Thus, it is envisaged that only a certain percentage of measured values or those converted by the integrated circuit are stored according to the duration of the dive and as evident from the above, and a value representing the period of recording these measurements in the memory zone 26.

The value representing the recording period can be the period itself or alternatively the total duration of the dive, the integrated circuit being programmed to deduce the value of the corresponding recording period therefrom without ambiguity.

The values of the depth variation rate calculated during the course of the dive are not actually stored, and this allows a saving of essentially half the memory used conventionally in the devices in the prior art.

In general, the present invention also relates to a method for displaying a history in a portable electronic device of the type described above, comprising in particular a sensor of a physical magnitude and having a first time operating mode, the method comprising the following steps:

a) firstly performing a periodic acquisition of the value of said physical magnitude as a function of time in a second mode of operation of the electronic device;

b) storing at least a portion of the measured values with a given period in the memory elements, c) storing a value representing this given period in the memory elements.

The method according to the invention differs from the methods of the prior art in that in a third operating mode, the history mode, it further comprises a subsequent step comprising:

d) performing a chronological display representing the stored values of the physical magnitude as a function of time, wherein at least a first of the analog display elements facing the graduations indicates the value of a variable directly linked to the stored values, and the second of the analog display elements facing said graduations is actuated to indicate the value of a variable calculated on the basis of at least two of the stored values.

Thus, when the history mode is activated, the controller circuit 21 actuates the motor means so that, on the one hand, the minute hand 17 scans the first graduations to display the depth values in relation to the stored measurements. On the other hand, the integrated circuit calculates a value of the depth variation rate for each of the stored values associated with a displayed depth.

At the start of the execution of the history mode, as in the dive mode, the value displayed for the depth variation rate is preferably artificial. For example, it can be provided that it firstly increases before being calculated on the basis of the first depth values stored.

After some instants, in the order of a few seconds, the depth variation rate can be calculated as a sliding average of the instantaneous speed calculated between the last two dives read to memory and of the average rate calculated in the last instance. In other words, the depth variation rate Vi can be calculated by the following formula:

$$Vi = \left(\frac{P_i - P_{i-1}}{T} + V_{i-1}\right)\Big/2$$

wherein Pi and Pi−1 respectively are depth values at the instants i and i−1, Vi−1 is the depth variation rate at the instant i−1, and T is the value of said given period Alternatively or additionally hereto, the rate Vi can be calculated by the following alternative formula:

$$V_i = \frac{P_i - P_{i-1}}{T}$$

The integrated circuit can possibly be programmed so that the first formula is used for dives of short duration, i.e. having a duration of less than 15 minutes, for example, while the second formula is used for dives of longer duration.

Another advantageous formula could be, for example:

$$V_i = \frac{P_{1+2} - P_{1-1}}{2T}$$

This formula, which is usable only in the history mode, has the advantage of minimising the time lag between the depth and the speed of ascent.

The present invention also provides the possibility of interrupting the execution of the history mode in response to an action of a user using one of the external control elements and preferably of resuming this in response to a new action of the user using one of the external control elements.

Moreover, the electronic circuits of the watch are preferably configured to implement a jump in the execution of the history mode in response to an action of a user using one of the external control elements. The effect of this jump in the operation is a control of the analog display elements, so that these shift the display of a first value associated with a first stored value Pi to the display of a second value associated with a second stored value Pj located chronologically before or after the first stored value Pi and spaced in time from the latter by more than once the value of the recording period. In parallel with this jump, the time displayed on the LCD 18 is modified accordingly.

By way of example, it can be provided that during the execution of the history mode, a pressure on the winding-button 9 causes an interruption in the execution, while a pressure on the pushbutton 7 causes a jump forwards of a predefined duration in the execution of the history mode, and that a pressure on the pushbutton 8 causes a jump backwards of this same predetermined duration in the execution of the history mode.

The electronic circuits of the watch can also be programmed so that extended applications of pressure on the pushbuttons cause the application of a succession of jumps in one direction or the other, i.e. an acceleration in the application of these jumps.

When a jump backwards is performed, at least the value of the measurement stored immediately before that corresponds to the depth that has to be displayed after the jump is read in order to calculate a repeat depth variation rate. In the case in question, the rate displayed by this means at the instant of the resumption of the execution of the history is an instantaneous rate.

It is also possible to provide, in general and most particularly in the case where a jump forwards occurs in the execution of the history, that at least the stored value that immediately follows the value, on the basis of which normal execution of the history is restarted, is read and taken into consideration in the calculation of the depth variation rate associated with the repeat depth rate. Such a measurement allows smoothing of the display of the depth variation rate to be conducted in the history mode.

Figure 3:
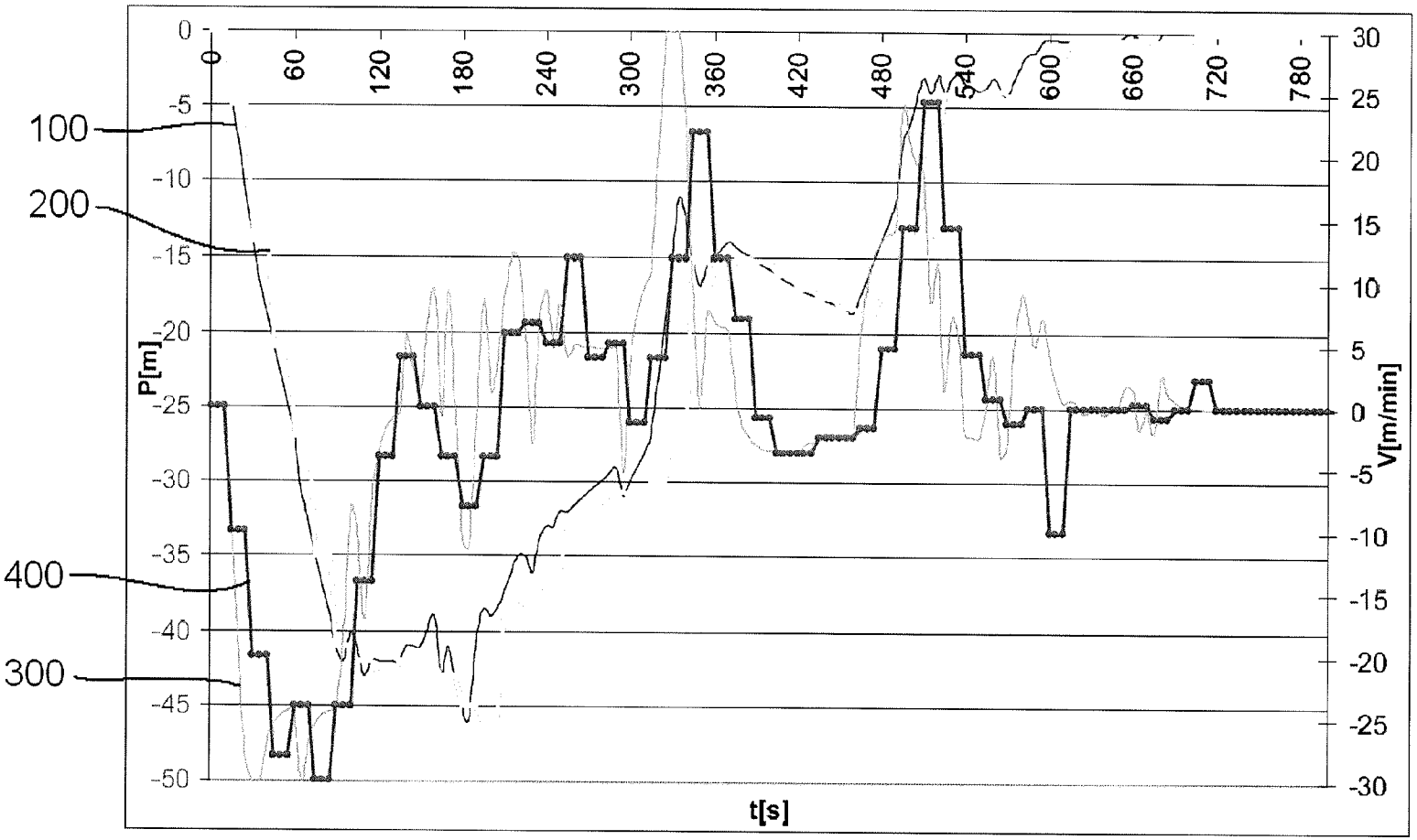
FIG. 3 is a schematic diagram, on which the curves representing measurements performed and recorded measurements corresponding to the depth and also curves representing calculations conducted to determine the depth variation rate in two different operating modes of the watch according to FIG. 1.

FIG. 3 shows a schematic diagram, in which curves for the depth as displayed during a dive (curve 100) and as reproduced in the history mode (curve 200), and also for the depth variation rate as displayed during a dive (curve 300) and as reproduced in the history mode (curve 400).

Since the recording period is longer than the period of measurements performed by the sensor, it is evident from these curves that the stored values give rise to value increments in the execution of the history. However, it must be noted that the execution of the history mode is conducted at accelerated speed, in principle, in relation to the execution of the dive, during which the measurements are recorded. Thus, the visible increments on the curve are practically indiscernible during the analog display of the history by means of hands 16 and 17.

The above description endeavours to describe a particular embodiment as a non-restrictive embodiment and the invention is not restricted, for example, to the described sequences of actions to activate or deactivate one operating mode or the other, to the measurement or recording periods specifically mentioned, to the numbers of external control elements, to the graduations as described and represented or even to the number of indicator hands used.

In practice, a skilled person could naturally provide that the device is adapted to allow the recording of several series of data associated with periods of activity, such as diving, spaced from one another in time without departing from the framework of the present invention. In this case, the invention is not limited to the method implemented to navigate around the different series of data recorded in the memory of the device.

It is also possible to provide that the read period for the stored values during execution of the history mode differs from the recording period of the measurements during a dive without departing from the framework of the invention.

As has already been mentioned above, the present invention is not restricted to a dive watch. It is possible to apply the contents of the present disclosure to the configuration of an altimeter, a barometer or indeed any other device having any type of sensor other than a pressure sensor, such as a temperature sensor.

What is claimed is:

1. A portable electronic device comprising a case containing a clock movement with a display mounted thereon and an external control element, said display comprising graduations and two analog display members arranged to face said graduations, said clock movement further comprising electronic circuits capable of producing time signals to be sent to control means of said display, wherein said electronic circuits are arranged to be selectively placed in one or the other of a plurality of operating modes, said plurality of operating modes comprising a first mode, the time mode, in which said display is provided to indicate the time, and the electronic device additionally comprising a sensor provided to perform a measurement of a physical magnitude and to repeat this measurement with a given frequency, said plurality of operating modes comprising a second mode, the acquisition mode, in which the two analog display members are provided to supply a first indication and a second indication respectively, said first indication being representative of the current value of said measurement, and said second indication being representative of a variation with time of said measurement, and the electronic device further comprising memory elements provided to record, in said acquisition mode, a succession of instantaneous values of said current value according to a given periodicity, said plurality of operating modes comprising a third mode, the history mode, in which said electronic circuits are provided to actuate said two analog display members so as to display in parallel within a predetermined time interval, on the basis of said succession of recorded values, two chronological value sequences, wherein a first of said sequences is directly representative of the values acquired by said measurement in said acquisition mode and the other of said sequences is calculated on the basis of said succession of recorded values and is representative of the variation with time of said measurement, wherein said electronic circuits are configured to implement a jump in the execution of said history mode in response to an action of a user using said external control element in order to control said display, so that the latter shifts from the display of a first value associated with a first stored value Pi to the display of a second value associated with a second stored value Pj located chronologically before or after said first stored value Pi and spaced in time from the latter by more than once the value of said given periodicity.

2. The device according to claim 1, wherein said memory elements comprise a random access memory and a non-volatile memory, wherein only a value representative of said given periodicity and said succession of values, each corresponding to an instantaneous value of said current value, are stored in said non-volatile memory.

3. The device according to claim 1, wherein said electronic circuits are configured to interrupt the execution of said history mode in response to an action of a user using said external control element.

4. The device according to claim 3, wherein said electronic circuits are configured to resume the execution of said history mode in response to a new action of a user using said external control element.

5. The device according to claim 1, wherein the value representative of the variation with time of said physical magnitude associated with said value Pj is calculated at least on the basis of the stored values Pj and Pj−1.

6. The device according to claim 5, wherein said sensor is a pressure sensor that enables the altitude and altitude variation rate or depth and depth variation rate to be displayed, and wherein said electronic circuits are configured to calculate, during an execution of said history mode without intervention from the user, the altitude or depth variation rate Vi according to the formula, $$Vi = \left(\frac{P_i - P_{i-1}}{T} + V_{i-1}\right) \Big/ 2$$

wherein Pi and Pi−1 are respectively values for altitude or depth at the instants i and i−1, Vi−1 is the altitude or depth variation rate at the instant i−1, and T is the value of said given period.

7. The device according to claim 6, wherein said electronic circuits are configured to calculate the altitude or depth variation rate Vi according to the following formula:

$$V_i = \frac{P_i - P_{i-1}}{T}$$

when the total duration of the measurements exceeds a predefined value.

8. The device according to claim 5, wherein in said second operating mode, said value representative of the variation in the time of said physical magnitude associated with said value Pj is calculated at least from variations between the stored values Pj and Pj−1, Pj−1 and Pj−2 and Pj−2 and Pj−3.

* * * * *